US006055759A

United States Patent [19]

Langner

[11] Patent Number: 6,055,759

[45] Date of Patent: May 2, 2000

[54] TRIGGER LOCK

[76] Inventor: F. Richard Langner, P.O. Box 14706, Scottsdale, Ariz. 85267

[21] Appl. No.: 09/086,115

[22] Filed: May 28, 1998

[51] Int. Cl.[7] ..... F41A 17/00

[52] U.S. Cl. ..... 42/70.07

[58] Field of Search ..... 42/70.01, 70.06, 42/70.07, 66; 70/33, 34, 14, 18, 19

[56] References Cited

U.S. PATENT DOCUMENTS

| | | | |
|---|---|---|---|
| 1,686,482 | 10/1928 | Windle | 42/70.07 |
| 2,505,227 | 4/1950 | Charters | 42/70.06 |
| 2,882,636 | 4/1959 | Shinaver | 42/70.06 |
| 2,893,152 | 7/1959 | Peluso | 42/70.07 |
| 3,164,919 | 1/1965 | Hall | 42/70.06 |
| 3,713,239 | 1/1973 | Sperling | 42/70.07 |
| 3,732,641 | 5/1973 | Adajian | 42/70.07 |
| 4,945,665 | 8/1990 | Nelson | 42/70.07 |
| 5,048,212 | 9/1991 | Mossberg . | |
| 5,724,760 | 3/1998 | Langner . | |
| 5,910,002 | 6/1999 | Hunter | 42/70.07 |

FOREIGN PATENT DOCUMENTS 100975 8/1923 Switzerland .

*Primary Examiner*—Charles T. Jordan
*Assistant Examiner*—Jeffrey Howell
*Attorney, Agent, or Firm*—LaValle D. Ptak

[57] ABSTRACT

A trigger lock for guns having a trigger guard and a trigger with a space between the rear of the trigger and the trigger guard comprises a main lock plug member or housing, which is inserted behind the trigger and which generally conforms to the space and size of the space behind the trigger. An integral flange on one side of the main lock housing contacts the side of the trigger. The main lock housing includes a partially hollowed out interior with a locking spring extending across an insert path for a projecting pin. The projecting pin is carried by a locking plate; and the pin snaps into place by the action of the locking spring. The locking plate is held on the other side of the trigger. Thus, the trigger is locked against use. A small opening is provided through the first flange; and a handcuff key or other device may be inserted through the opening to engage the spring to release the pin. This then releases the locking plate to remove the trigger lock.

11 Claims, 2 Drawing Sheets

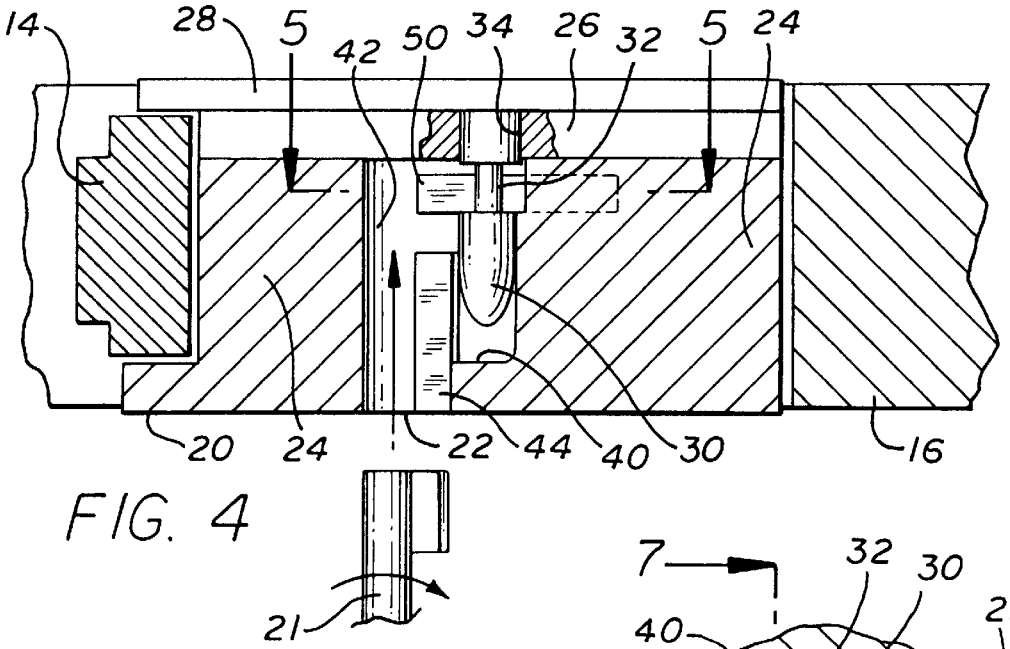
FIG. 4
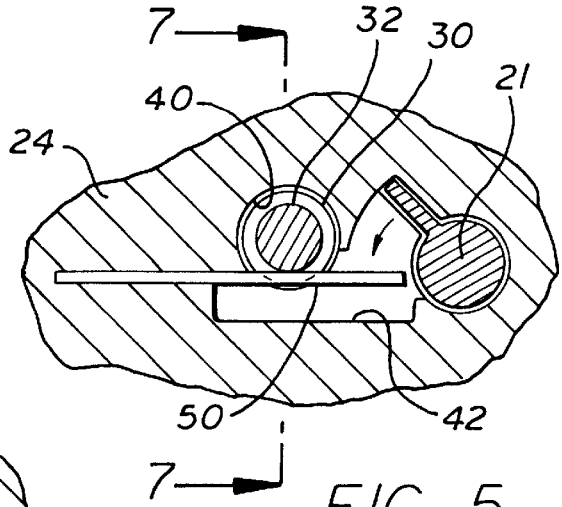
FIG. 5
FIG. 6
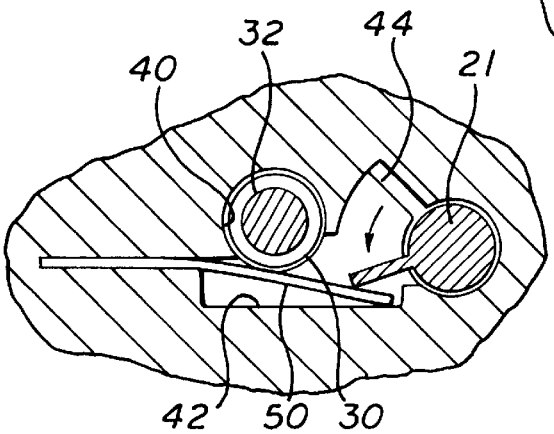
FIG. 7
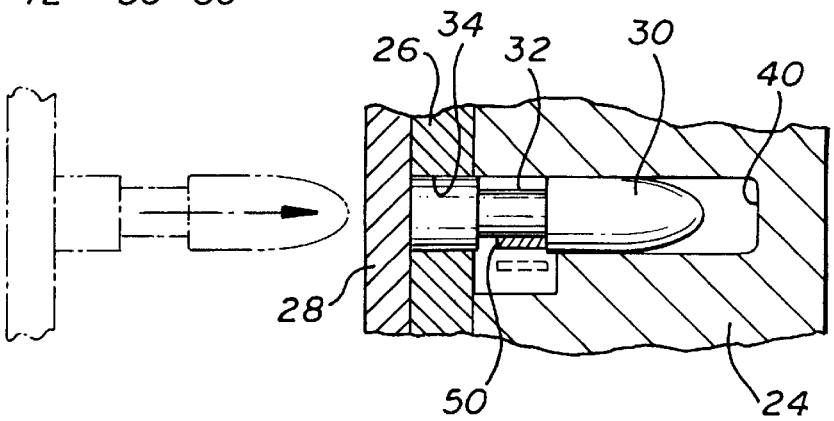

TRIGGER LOCK

BACKGROUND

Handguns are in widespread use, both by law enforcement agencies and by people who carry guns for their own protection. Inadvertent discharge of such handguns frequently occurs through mishandling of a gun in a casual manner by someone who is unaware that the gun is in firing condition (chamber loaded). Devices have been designed to lock the trigger of a gun against inadvertent actuation. Such devices include safety locks built into the guns, as well as slide buttons in the rear of the trigger guard. Some devices employ locks with keys. Others are cumbersome and difficult to use.

A number of devices have been proposed for trigger blocks of the type intended to prevent intentional misuse or unauthorized use of handguns. Blocks of this type are not really locks in the sense that they prevent unauthorized use; but such trigger blocks operate primarily as safety devices. Blocks of this type are particularly desirable for guns carried by police officers. Some trigger block devices are in the form of wedges which are placed behind the trigger, between the trigger and the trigger guard. These wedges then are pushed out of the way when the gun is to be fired. Other safety blocks include plates which are engaged by the finger of the user to rotate or release the plates in order to ready the gun for firing.

A danger, particularly with respect to handguns, occurs when such handguns are stored at home or brought home by a law enforcement officer. Children are very curious about handguns, and even though admonished not to do so, they will pick up and handle a handgun if it is accessible to them. Consequently, there has been a great interest in providing locks which prevent the operation of the handgun and prevent operation of the trigger to fire the handgun.

One type of trigger safety device, which functions to prevent use of a handgun is disclosed in the Langner U.S. Pat. No. 5,724,760. The Langner patent discloses a trigger block devices, which primarily is designed as a block to be placed behind the trigger of the handgun at all times, and which readily may be moved out of engagement with the trigger when the handgun is desired to be used. The Langner block, however, also includes a projection beyond one side of the trigger with a hole through it. A small padlock may be placed through this hole, which then prevents movement of the block from behind the trigger, since the padlock engages the trigger guard and trigger if an effort is made to push the trigger block out of the space behind the trigger. The other side of the trigger is covered by a flange attached to the block; so that it cannot be moved in the opposite direction. A disadvantage of the device shown in the Langner patent, however, is the requirement for the extra padlock, which must be inserted through the hole in the projecting part of the trigger block in order to lock the device in place. A separate key, as well as the separate padlock, must be employed. If the padlock should be misplaced, the trigger block still may be used; but the safety locking feature clearly would be missing.

Another trigger blocking and locking mechanism for insertion behind the trigger of a handgun is disclosed in the Mossberg U.S. Pat. No. 5,048,212. In the Mossberg device, a composite trigger and firearm lock assembly includes, in part, a trigger block which is inserted behind the trigger of the firearm. This trigger block includes a flange on one side and an extension perpendicular to the flange, configured to fit behind the curved rear surface of the trigger of the firearm. The extension in the Mossberg device is uniform in cross section throughout its length; and it extends from the side of the flange and the trigger guard when the device is inserted past the trigger and beyond the trigger guard on the opposite side. A hole is provided through the extension for insertion of a locking cable, which then is used to prevent removal of the Mossberg device and use of the gun when the trigger is to be "locked", relatively permanently, against use.

Other types of trigger locks have been designed in the form of devices which place a bar in front of the trigger. This makes the locking device itself dangerous to use, because of the potential of the locking bar itself actuating the trigger during installation. Conventional trigger locks of this type usually come with an instruction which warns the user to "unload gun prior to use". If that warning is not heeded an accidental discharge can occur. Even if the warning is heeded, accidents are prone to happen when unloading and loading a firearm to install such trigger locks.

It is desirable to provide a simple to use, compact and effective trigger lock which may be used on a loaded gun, as well as unloaded guns, and which is simple in construction and effectively prevents unauthorized removal.

SUMMARY OF THE INVENTION

It is an object of this invention to provide an improved trigger lock for a gun.

It is a further object of this invention to provide an improved trigger lock for a handgun.

It is an additional object of this invention to provide an improved trigger lock device for a handgun which is easy to use and which snaps into place to securely lock the trigger.

It is a further object of this invention to provide an improved trigger lock device for guns, which is placed behind the trigger and which includes flanges which snap together on opposite sides of the trigger to secure the device in place.

In accordance with a preferred embodiment of the invention, a trigger lock is designed for guns having a trigger guard and a trigger, with a space between the rear of the trigger and the guard. The lock includes a rigid plug with a central portion configured to fit into the space between the rear of the trigger and the trigger guard to prevent depression of the trigger to fire the gun. One side of this rigid plug has a flange which overlies and engages at least part of the trigger or trigger guard when the plug is inserted into place. The other side of the trigger lock comprises a separate locking plate which has a pin extending from it. The locking pin is inserted into a corresponding channel in the hollow interior of the rigid plug to engage a spring, which then retains the locking plate in place on the opposite side of the trigger and trigger guard. To unlock the device, a key, such as a handcuff key, is inserted through an opening in the rigid plug to depress the spring, disengaging the locking pin; so that the locking plate can be removed.

BRIEF DESCRIPTION OF THE DRAWINGS

FIG. 4 is a cross-sectional view of the embodiment of FIG. 1 taken along the line 4—4 of FIG. 1;

FIG. 5 is a cross-sectional view taken along the line 5—5 of FIG. 4;

FIG. 6 is a cross-sectional view of the same portion shown in FIG. 5 illustrating a different position of use; and FIG. 7 is a cross-sectional view taken along the line 7—7 of FIG. 5.

DETAILED DESCRIPTION

Figure 1:
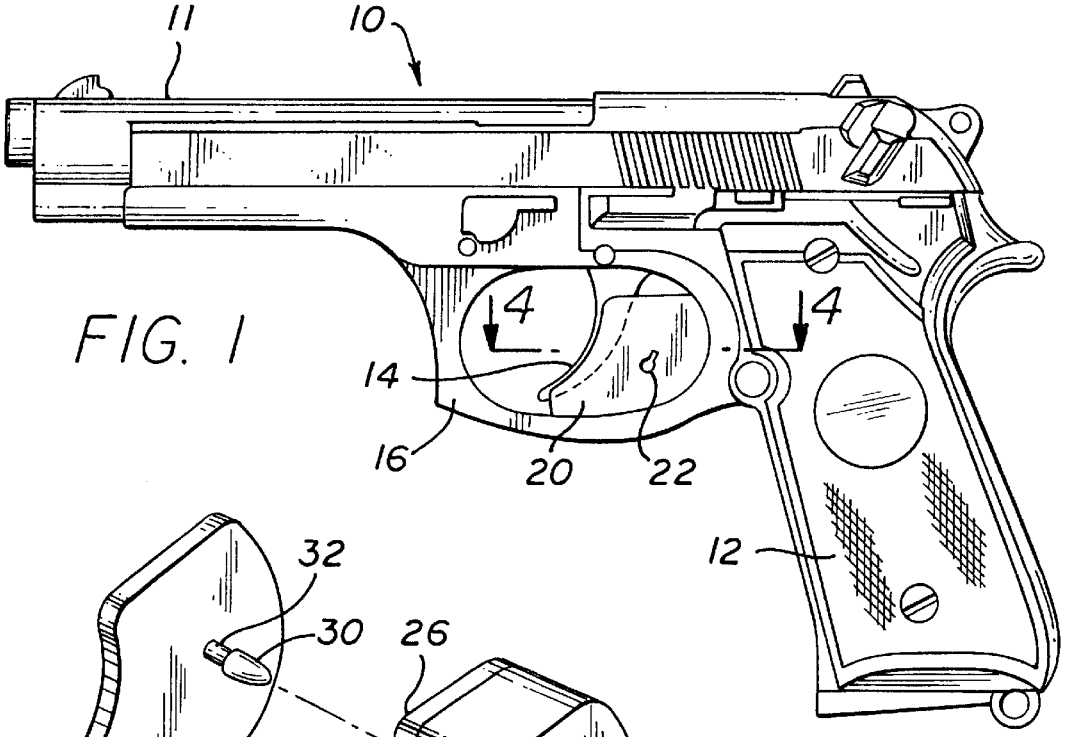
FIG. 1 is a side view of a handgun with a preferred embodiment of the invention shown in its position of use.

Reference now should be made to the drawings, in which the same reference numbers are used throughout the different figures to designate the same components. FIG. 1 is a side view of a handgun 10 of a type commonly used by law enforcement officers and others. The handgun 10 comprises a barrel portion 11 and a handgrip portion 12, with a trigger 14 enclosed by a trigger guard 16. The handgun which is depicted in FIG. 1 is a semi-automatic pistol. Various other features of the handgun which are not important to the understanding of the present invention will not be described here.

As is apparent from an examination of FIG. 1, the trigger 14, in its released or ready state, is spaced from both the rear and the front of the trigger guard 16. The space in front of the trigger 14 permits insertion of the index finger of the user; and the space behind the trigger 14 allows the trigger to be pulled back to effect firing of the gun.

To prevent accidental or unauthorized firing of the handgun 10 shown in FIG. 1, a trigger lock is inserted behind the trigger to occupy the space behind the trigger 14 and the rear and bottom of the trigger guard 16 to prevent firing or operation of the handgun. The trigger lock is illustrated in FIGS. 2 through 7 of the drawings. It includes a central portion 24 in the form of a rigid plug (preferably made of metal or high impact plastic) having a surface configured to generally conform to the shape and size of the rear of the trigger 14. The rear of the trigger lock central portion 24 also is configured to generally conform to the shape and size of the trigger guard located to the rear of the trigger 14, as viewed in FIG. 1. One side of the central portion 24 of the plug is covered by a flange 20, at least a portion of which extends over or beyond the trigger 14, as illustrated most clearly in FIG. 1 and as also shown in the cross-sectional view of FIG. 4. When the device is inserted into place, the flange 20 overlies one side of the trigger 14, as clearly shown in FIG. 4; and the central portion 24 of the rigid plug occupies the space between the trigger 14 and the rear of the trigger guard 16, again as shown most clearly in FIGS. 1 and 4. It should be noted that the trigger always is in view when the lock is being installed; so that unintentional movement of the trigger is minimized.

Figure 2:
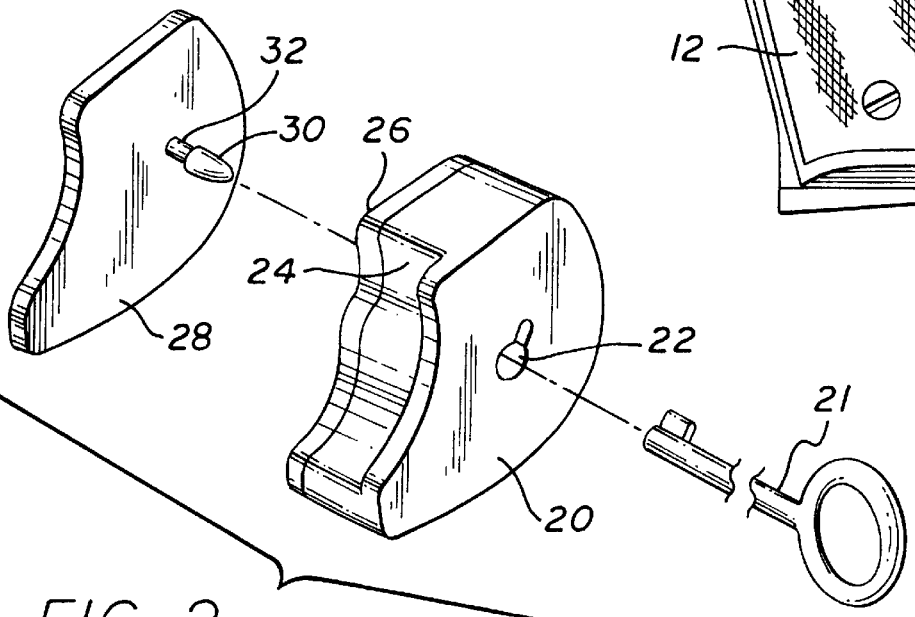
FIG. 2 is an exploded perspective view showing different parts of the embodiment of FIG. 1.
Figure 3:
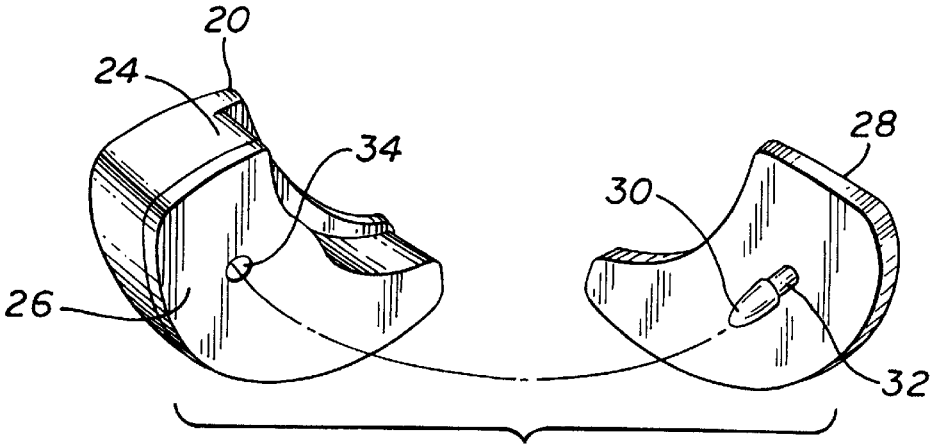
FIG. 3 is another exploded view showing other details of the embodiment of FIG. 1.

A locking plate 28 has a configuration which is similar to the configuration of the flange 20; and the locking plate has a projecting retention pin 30 (preferably made of steel or other suitable alloy) extending from it. The pin 30 has a rounded or bullet-shaped head or nose on it; and there is a groove or smaller diameter portion 32 between the head 30 and the inside of the locking plate flange 28. As illustrated in FIGS. 2 and 3, the pin 30 is inserted through an opening 34 in a dust plate 26, which is placed on the side of the central portion of the plug 24 opposite that of the flange 20. When the pin 30/32 is inserted in the manner illustrated in FIGS. 2 and 3, the locking plate 28 is firmly engaged and held in place inside the main body portion of the plug 24 by engagement of the pin 30/32 by a wire or leaf spring 50 extending across a portion of a cylindrical passage 40, into which the pin 30/32 is inserted.

As shown in FIGS. 4, 5, 6 and 7, the interior of the central portion 24 or plug portion of the lock is partially hollow. The cylindrical passage 40 is provided for the pin 30/32, as described previously. In addition, an opening 22 is formed through the rigid plug on the side of the flange 20 to permit insertion of a handcuff key 21, as illustrated in FIGS. 2 and 4. A slot 44 is used to guide the projection on the end of the shaft of the key 21, with the shaft 21 extending through a second cylindrical passage adjacent the passage 40 and parallel to it, but slightly offset below the passage 40, as illustrated in FIGS. 5 and 6. When the key shaft 21 is inserted through the opening 22, the projection on the end is guided through the slot 44, as shown in FIG. 6. Once the key shaft 21 is fully inserted to the position where the end of the key shaft abuts the dust plate 26, the projection on the end of the key shaft overlies the spring 50, which is captivated in the interior of the block 24 and extends partially across the lower part of the passage 40, as illustrated in FIGS. 4 and 5.

When the key shaft 21 is fully inserted, it then is turned in the direction of the arrow in FIG. 5 to depress the end of the spring 50 downward into the space 42, as shown in FIG. 6. This then pulls the spring 50 out of engagement with the recessed portion 32 of the pin 30; so that the pin 30 may be removed along with the locking plate 28.

FIG. 7 shows in solid lines the locked position of the locking plate 28 and pin 30/32. In the solid line position, the leaf spring 50 is shown as resting against the narrow diameter portion 32 on the pin; so that the shoulder on the reverse side of the head portion 30 engages the spring 50 and prevents the locking plate 28 and pin 30/32 from being withdrawn through the opening 34 in the dust plate 26. When the key 21 is rotated to the position shown in FIG. 6, the dotted line configuration of the spring 50 occurs, where the spring 50 is lowered beneath the shoulder on the rear side of the head portion 30 of the pin. This then allows the pin 30/32 to be withdrawn from the cylindrical opening 40; so that the locking plate 28 can be withdrawn along with the pin 30/32.

The foregoing description of the preferred embodiment of the invention is to be considered illustrative and not as limiting. Various changes and modifications will occur to those skilled in the art for performing substantially the same function, in substantially the same way, to achieve substantially the same result without departing from the true scope of the invention as defined in the appended claims.

What is claimed is:

1. A trigger lock for guns having a trigger guard and trigger therein with a space between the rear of the trigger and the trigger guard, said lock including in combination:

a rigid plug member having a central portion configured to fit into the space between the rear of a trigger and a trigger guard of a gun to prevent depression of said trigger to fire the gun, said central portion of said rigid plug having first and second opposite sides;

a flange on the first side of said central portion of said rigid plug member overlapping at least part of one of said trigger and said trigger guard in engagement therewith, when said central portion of said rigid plug member is located in said space;

the interior of said central portion of said rigid plug member having a hollow portion with access to said hollow portion provided in the form of a first opening in said rigid plug;

a locking plate with an engagement member projecting therefrom for insertion through a second opening on said second side of said central portion of said plug member to overlap at least part of one of said trigger and said trigger guard in engagement therewith on the opposite side of said trigger from said flange, said engagement member comprising a projecting pin with a free end and having a reduced diameter portion between said locking plate and the free end of said pin for engagement by said releasable locking device; and a releasable locking device located in the hollow portion of said central portion of said rigid plug for engaging said engagement member on said locking plate to secure said locking plate to said plug member thereby locking said trigger against use.

2. The combination according to claim 1 wherein said releasable locking device comprises a flexible spring mounted in the hollow portion of said plug member and resting on said reduced diameter portion of said pin in the locking position thereof and being releasable from the locking position by movement out of engagement with the reduced diameter portion of said pin.

3. The combination according to claim 2 wherein said spring is designed to be moved out of engagement with the reduced diameter portion of said pin by means of a key inserted into the first opening in said rigid plug.

4. The combination according to claim 3 wherein said free end of said projecting pin is tapered to cam said spring into engagement with said reduced diameter portion of said pin as said locking plate is pressed into locking engagement with said rigid plug member.

5. The combination according to claim 4 wherein said hollow portion of said rigid plug member includes a guide path for said projecting pin, and wherein said flexible spring extends partially into said guide path for engagement by said tapered free end of said pin as said locking plate is pressed into place on said rigid plug member.

6. The combination according to claim 5 wherein said central portion of said plug member has a trigger-engaging surface dimensioned to generally correspond with the dimensions of the rear of said trigger and said central portion of said plug member is further dimensioned to correspond with the shape of said trigger guard to the rear of said trigger.

7. The combination according to claim 6 wherein the second side of the central portion of said rigid plug member is closed with a cover plate having an aperture located therein providing access to the hollow interior thereof.

8. The combination according to claim 7 wherein said rigid plug, said first flange and said locking plate are made of metal.

9. The combination according to claim 7 wherein said rigid plug, said first flange and said locking plate are made of plastic.

10. The combination according to claim 2 wherein said free end of said projecting pin is tapered to cam said spring into engagement with said reduced diameter portion of said pin as said locking plate is pressed into locking engagement with said rigid plug member.

11. The combination according to claim 10 wherein said hollow portion of said rigid plug member includes a guide path for said projecting pin, and wherein said flexible spring extends partially into said guide path for engagement by said tapered free end of said pin as said locking plate is pressed into place on said rigid plug member.

* * * * *